US007090556B2

(12) United States Patent
Maleika

(10) Patent No.: US 7,090,556 B2
(45) Date of Patent: Aug. 15, 2006

(54) TOY VEHICLE FOR GUIDED MOTOR-RACING CIRCUITS

(75) Inventor: Hubertus Maleika, Zirndorf (DE)

(73) Assignee: Stadlbauer Spiel-Und Freizeitartikel GmbH, Nuremberg (DE)

( * ) Notice: Subject to any disclaimer, the term of this patent is extended or adjusted under 35 U.S.C. 154(b) by 58 days.

(21) Appl. No.: 10/522,243

(22) PCT Filed: Jul. 16, 2003

(86) PCT No.: PCT/DE03/02392

§ 371 (c)(1),
(2), (4) Date: Jan. 25, 2005

(87) PCT Pub. No.: WO2004/016333

PCT Pub. Date: Feb. 26, 2004

(65) Prior Publication Data

US 2005/0202751 A1 Sep. 15, 2005

(30) Foreign Application Priority Data

Jul. 25, 2002 (DE) ..... 102 33 897
Sep. 17, 2002 (DE) ..... 102 43 150

(51) Int. Cl.
*A63H 18/10* (2006.01)

(52) U.S. Cl. ..... 446/446; 446/460; 446/468; 104/242

(58) Field of Classification Search ..... 446/446, 446/460, 456, 129, 465, 468, 444, 445; 104/242, 104/305; 273/86 B
See application file for complete search history.

(56) References Cited

U.S. PATENT DOCUMENTS

| | | | | |
|---|---|---|---|---|
| 3,774,340 | A | 11/1973 | Barlow et al. | |
| 4,156,987 | A | 6/1979 | Lahr | |
| 4,221,077 | A | 9/1980 | Von Winckelmann | |
| 4,795,154 | A | 1/1989 | Lahr | |
| 4,846,073 | A * | 7/1989 | Boyer et al. | 104/130.09 |
| 4,854,909 | A * | 8/1989 | Ishimoto | 446/129 |
| 4,940,444 | A * | 7/1990 | Russell | 446/446 |
| 5,075,515 | A * | 12/1991 | Yoneda et al. | 191/22 C |
| 5,851,134 | A * | 12/1998 | Chiu | 446/468 |
| 5,970,882 | A * | 10/1999 | Smith et al. | 104/60 |
| 6,401,625 | B1 * | 6/2002 | Henderson | 104/242 |
| 2001/0010196 | A1 * | 8/2001 | Maleika | 104/53 |

* cited by examiner

*Primary Examiner*—Kien Nguyen

(74) *Attorney, Agent, or Firm*—Lowe, Hauptman & Berner, LLP

(57) ABSTRACT

A toy vehicle for a guided motor-racing circuit has a guiding groove and conductor rails adjacent thereto. A keel pivotably mounted on the vehicle engages the guiding groove to aid vehicle guidance. A magnetic device magnetically interacts with the conductor rails to provide additional retaining force for holding the toy vehicle on the track. One end of a rocker is pivotably fixed to the vehicle. The magnetic device is positioned on the rocker at a distance from the pivotable connection. If the vehicle moves off course by pivoting along its longitudinal axis about the keel, the rocker pivots in an opposite manner relative to the vehicle, so the magnetic device remains on the circuit adjacent the rails such that even if the toy vehicle moves off course, a magnetic force of attraction remains between the magnetic device and the conductor rails.

18 Claims, 3 Drawing Sheets

TOY VEHICLE FOR GUIDED MOTOR-RACING CIRCUITS

CROSS-REFERENCE TO RELATED APPLICATIONS

This is a U.S. National Phase application and claims the benefit of the filing date of PCT/FR2003/002392, filed Jul. 16, 2003, and also claims the benefit of priority under 35 U.S.C. §119 of German Application Nos. 102 33 897.3 and 102 43 150.7, filed Jul. 25, 2002, and Sep. 17, 2002, respectively, the entire disclosures of which are hereby incorporated herein by reference.

FIELD OF THE INVENTION

The invention relates to a toy vehicle for a motor-racing circuit with guidance by tracks, which circuit has a guiding groove and conductor rails adjacent to said groove, there being provided for the guidance by tracks a keel, which is pivotably arranged on the toy vehicle, for engagement in the guiding groove in the motor racing circuit, there also being arranged on the toy vehicle a magnetic device which interacts with the conductor rails on the motor racing circuit, by means of magnetic attraction, in such a way that an additional retaining force holds the toy vehicle in the track on the motor-racing circuit.

BACKGROUND ART

The aim with motor-racing circuits having guidance by tracks is for a toy vehicle to be guided around the circuit as quickly as possible in a race by controlling its speed of travel. In the course of this a keel engages in a guiding groove and ensures that the toy vehicle follows the path of the racing circuit. For this purpose, the keel is arranged to be pivotable on a chassis of the toy vehicle about an axis perpendicular to the plane of the circuit. A particular attraction in this case lies in the fact that, in a similar way to some model, a driver can cause the toy vehicle to drift through bends in the circuit. However, what often happens in this case is that, if speed on the bend is too high, the toy vehicle flips out of the guide and is flung off the course. If this happens, on the one hand unwanted damage may be done to the toy vehicle. On the other hand, players often find it a nuisance that, particularly with large circuits, the player or a helper has to pick the toy vehicle up and put it back down on the course exactly on the track before the player concerned can resume the race.

To stop the toy vehicle from flipping out of the guiding track, it is known from U.S. Pat. No. 4,795,154, for example, for a guide pin having an undercut to be arranged in the guiding groove so that although the guide pin is longitudinally displaceable in the guiding groove, it cannot be withdrawn from the groove. The toy vehicle is not, however, prevented in this case from rotating through 180° about the guide pin, i.e., in a direction opposite to the direction of travel, if its speed in a bend is too high. Also, some of the tension is lacking from the race, because, to a limited degree, it is perfectly desirable that gross mistakes in driving, such as, for example, going into a bend at maximum speed, should continue to be punished by the toy vehicle flipping out of the guiding track.

It is an object of the present invention to provide a toy vehicle of the above kind which permits drifting at high speed, in a similar way to some model, through bends in the circuit, with flipping out of the track being impeded but not completely ruled out.

SUMMARY OF THE INVENTION

This object is achieved by a toy vehicle of the above kind having the features characterised in claim 1. Advantageous embodiments can be seen from the other claims.

For this purpose, provision is made in accordance with the invention for a swinging member to be pivotably fixed to the toy vehicle at one end and for the magnetic device to be arranged on the swinging member, at a distance from the pivotable fixing, the pivotable fixing being so designed that, if there is drift by the toy vehicle in the form of pivoting of a longitudinal axis of the toy vehicle relative to the motor-racing circuit, about the keel of the toy vehicle as a centre of rotation, the swinging member pivots relative to the toy vehicle in the opposite direction in such a way that the magnetic device remains adjacent to the conductor rails on the motor-racing circuit, so that there is a magnetic force of attraction available between the magnetic device and the conductor rails even if drift occurs.

This has the advantage that the magnetic retaining force between the magnetic device and the conductor rails is maintained even when the toy vehicle is travelling through bends and drifting when so doing, thus enabling drift, similar to that of some model, through bends on the motor-racing circuit to be performed at a higher speed, without the risk of the toy vehicle being flung out of the track.

The magnetic device is usefully arranged at a free end of the swinging member opposite from the pivotable fixing.

In a particularly advantageous manner, the magnetic device has at least one permanent magnet.

To enable surface unevennesses to be adapted to in an improved fashion, the swinging member is divided between the pivotable fixing and one free end and has a pivoting joint at that point.

In a preferred refinement of the invention, provision is made in accordance with the invention for that part of the swinging member which is arranged on the side of the pivoting joint remote from the pivotable fixing of the swinging member to the toy vehicle to carry the magnets and to be guided on at least one guide rail.

A layout which is particularly reliable in operation and space-saving can be obtained by making the at least one guide rail straight and by giving the pivoting joint between the parts of the swinging member, in addition, a cam-and-follower connection so that, when the swinging member pivots relative to the toy vehicle, the two parts of the swinging member also perform a translatory/pivoting movement relative to one another.

By designing the at least one guide rail in such a way that, if the swinging member pivots relative to the toy vehicle out of a centre position in which the member is aligned substantially parallel to a longitudinal axis of the toy vehicle, the magnetic device performs a translatory movement towards the motor-racing circuit, the magnetic device is situated closer to the conductor rails when the swinging member is pivoted, thus producing a higher magnetic force of attraction. Because of this, the magnetic force of attraction which holds the toy vehicle in the track is greater when it drifts in bends and smaller when it is travelling in a straight line without drifting, when less retaining force is needed anyway. This translatory movement of the magnetic device is forced to occur by, for example, the above-mentioned guide rail, the guide rail being arranged to slope down towards the motor-racing circuit from the centre position of the swinging member.

Additional damping of the pivoting movement of the toy vehicle when drifting in bends, and hence improved retention of the toy vehicle in the track when drifting in bends, is obtained by providing a spring device which exerts a returning force on the swinging member, towards the latter's centre position in which the swinging member is aligned substantially parallel to a longitudinal axis of the toy vehicle.

As an option, the pivotable fixing may have a guide rod which guides the swinging member in the latter's pivoting movement.

By designing the pivotable fixing in such a way that, if the swinging member pivots relative to the toy vehicle out of a centre position in which the swinging member is aligned substantially parallel to a longitudinal axis of the toy vehicle, the magnetic device performs a translatory movement towards the motor-racing circuit, the magnetic device is situated closer to the conductor rails when the swinging member is pivoted, thus producing a higher magnetic force of attraction. Because of this, the magnetic force of attraction which holds the toy vehicle in the track is greater when it drifts on bends and smaller when it is travelling in a straight line without drifting, when less retaining force is needed anyway. This translatory movement of the swinging member is forced to occur by means of, for example, the above-mentioned guide rod, the guide rod being arranged to slope down towards the motor-racing circuit from the centre position of the swinging member.

To allow a situation in which the toy vehicle is about to drop out of the track to be recognised, a contact device is provided which, when a predetermined, and in particular maximum, angle of pivot of the swinging member relative to the toy vehicle is reached, acts on, and preferably reduces or limits, a traction current to a drive motor of the toy vehicle. The contact device has, on both sides for example in relation to the swinging member, mechanical contacts which abut physically at respective end positions of the swinging member and trigger a contact for activating the contact device. The mechanical contacts are arranged on the swinging member or on the toy vehicle.

In a preferred embodiment of the invention, the swinging member is connected to the keel of the toy vehicle to be solid in rotation therewith. This couples the pivoting of the swinging member to the pivoting of the keel if there is a drifting movement by the toy vehicle and thus automatically ensures that the magnetic device remains above the conductor rails even during travel through a bend with drift.

To compel the swinging member to perform a pivoting movement in such a way that the magnetic device remains above the conductor rails even if there is a drifting movement by the toy vehicle, the swinging member is pivotably mounted independently of the keel and has, in the region of the magnetic device, a guide keel which engages in the guide groove of the motor-racing circuit. This additional guide keel belonging to the swinging member at the same time increases a force for retaining the toy vehicle in the track.

BRIEF DESCRIPTION OF THE DRAWINGS

The invention will be explained in detail below by reference to the drawings. In the drawings.

DETAILED DESCRIPTION OF THE DRAWINGS

Figure 1:
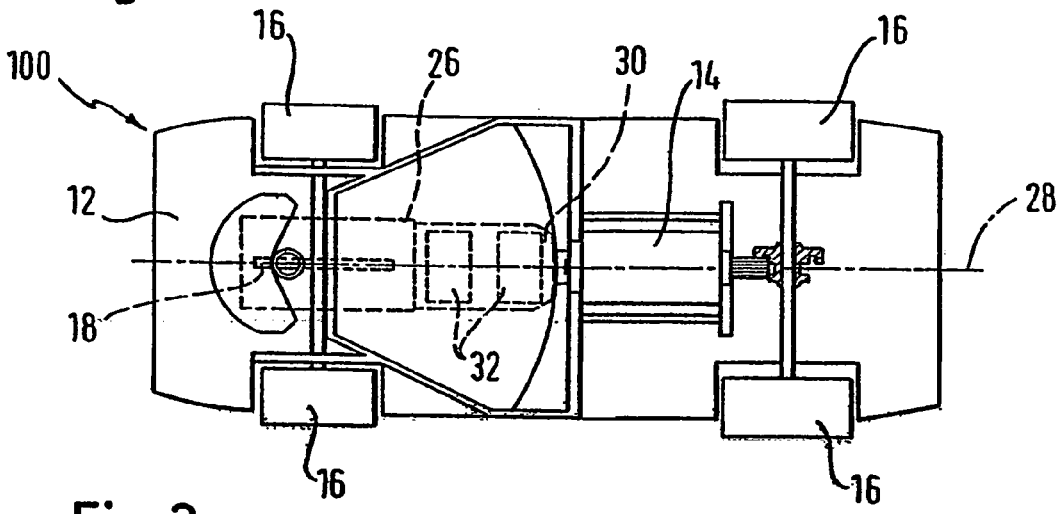
FIG. 1 is a view from above showing a preferred embodiment of toy vehicle according to the invention with the bodywork removed.
Figure 2:
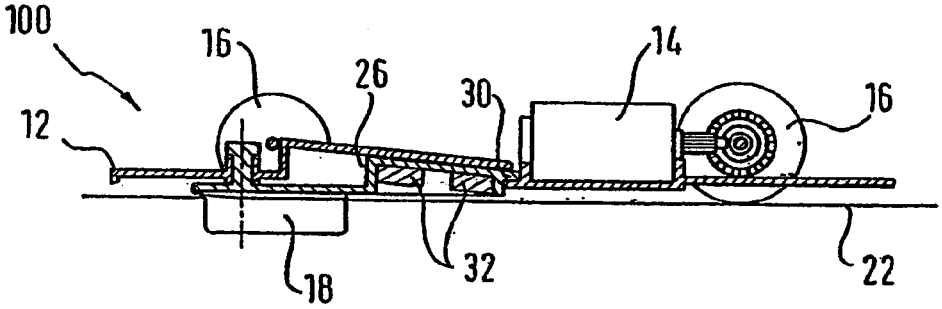
FIG. 2 is a longitudinal section through the toy vehicle of FIG. 1.
Figure 3:
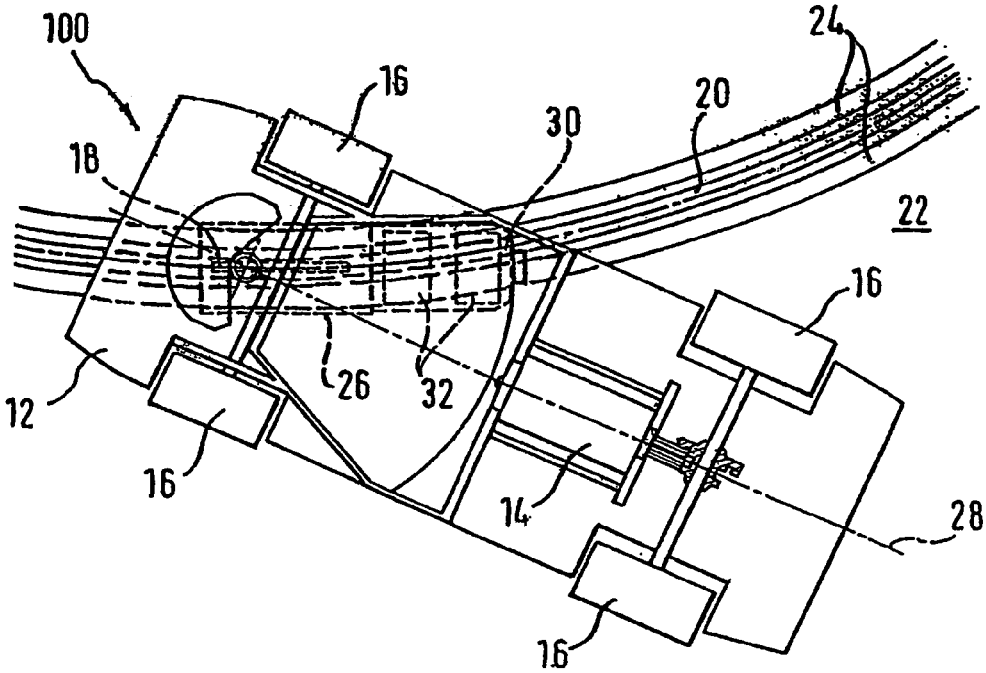
FIG. 3 is a plan view of the toy vehicle of FIG. 1 when travelling through a bend with drift.

FIGS. 1 to 3 show a preferred embodiment of toy vehicle 100 according to the invention. For greater clarity of depiction, the toy vehicle 100 is shown without bodywork. The toy vehicle 100 comprises a chassis 12, a drive motor 14, wheels 16 and a keel 18, which latter is designed to engage in a guide groove 20 in a motor-racing circuit 22 and has current collectors (not shown) which are in electrical contact with conductor rails 24 next to the guide groove 20. The conductor rails 24 are made of an electrically conductive and magnetic material. A swinging member 26 is provided which is connected to the keel 18 to be solid in rotation therewith. Together with the keel 18, this swinging member 26 is pivotably fixed to the chassis 12. As a result of this, the swinging member 26 pivots in relation to the chassis 12 if the keel 18 pivots during travel through a bend with drift. This can be seen in FIG. 3. What the term "drift" denotes in this case is a state of the toy vehicle 100 in which, when travelling through a bend in the circuit 22, a longitudinal axis 28 of the toy vehicle 100 is pivoted in relation to the circuit 22 at the centre of rotation of the keel 18. Expressed in another way, the longitudinal axis 28 and a direction of travel of the toy vehicle 100 make an angle greater than zero, a so-called angle of drift, with one another. When this is the case, the toy vehicle 100 does not simply drive through the bend but moves through it in a slide, i.e. the rear wheels 16 in particular which are arranged adjacent the motor 14 are substantially no longer in a state of adhesive friction and there is now only sliding friction between the wheels 16 and the circuit 22.

Arranged at one free end 30 of the swinging member 26 is a magnetic device in the form of two permanent magnets 32. The magnets 32 are so arranged in this case that they are close to the conductor rails 24. This produces a magnetic force of attraction between the magnetic device 32 and the conductor rails 24. This magnetic force of attraction acts in this case as a force which holds the toy vehicle 100 in the track and thus counteracts any flinging of the toy vehicle 100 off the circuit 22.

As a result of the above-mentioned pivoting movement of the swinging member 26 together with the keel 18 during the drift through the bend, the magnets 32 now remain close to the conductor rails 24, which means that the magnetic retaining force continues to exist between the magnetic device 32 and the conductor rails 24 even during the drift. Because of this it is possible for the toy vehicle 100 to be made to drift through the bend even faster, without the toy vehicle 100 being flung off the circuit 22 when this is done. In this first embodiment, the pivoting of the swinging member 26 is coupled to the pivoting movement of the keel 18.

Figure 4:
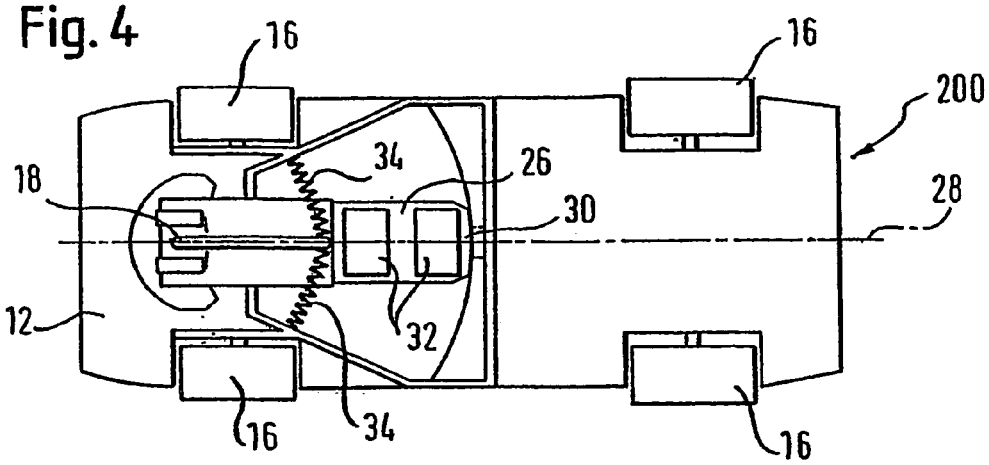
FIG. 4 is a top view of a second preferred embodiment of a toy vehicle according to the invention with the bodywork removed.

FIG. 4 shows a second preferred embodiment of toy vehicle 200, with parts which perform the same function being given the same reference numerals, for which reason the reader is referred to the above description of FIGS. 1 to 3 for explanations of such parts. In this second embodiment of toy vehicle 200, coil springs 34 are provided which are arranged on both sides of the swinging member 26 and are each supported at one end against the swinging member 26 and at an opposite end against an abutment on the chassis 12 of the toy vehicle 200. As a result of this, a returning force acts on the swinging member 26 in the direction of the centre position, in which the swinging member 24 is aligned substantially parallel to the longitudinal axis 28 of the toy vehicle 200. This returning spring-generated force causes damping of the pivoting movement of the swinging member 26 and thus also damps the toy vehicle 200 from breaking out of its direction of travel when drifting through a bend. This also produces a braking action on the toy vehicle 200 which is all the greater the greater the angle of drift. This advantageously counteracts any flinging of the toy vehicle 200 off the circuit 22 when travelling through bends.

Figure 5:
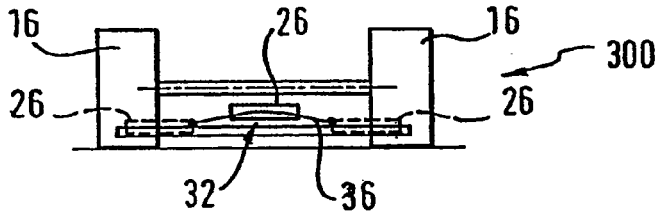
FIG. 5 is a view from the rear showing a third preferred embodiment of toy vehicle according to the invention with the bodywork removed.

FIG. 5 shows a third preferred embodiment of toy vehicle 300, with parts which perform the same function being given the same reference numerals, for which reason the reader is referred to the above description of FIGS. 1 to 4 for explanations of such parts. In this third embodiment of toy vehicle 300, the swinging member 26 is guided in its pivoting movement along a rod 36. The rod 36 is so designed in this case that, when the swinging member 26 is in the centre position, the rod 36 is at a predetermined maximum distance from a surface of the circuit, which distance becomes increasingly small as the swinging member 26 moves towards maximum pivot, i.e. the rod 36 is designed to slope down towards the circuit 22 in the direction of pivot. This produces a shorter distance between the magnetic device 32 and the conductor rails 24. When the swinging member 26 is pivoted, i.e. during drift through a bend, this generates a higher magnetic retaining force than when the swinging member 26 is in the centre position, i.e. during travel in a straight line, when less retaining force is wanted anyway because this opposes any acceleration of the toy vehicle 300 in an undesirable way.

Figure 6:
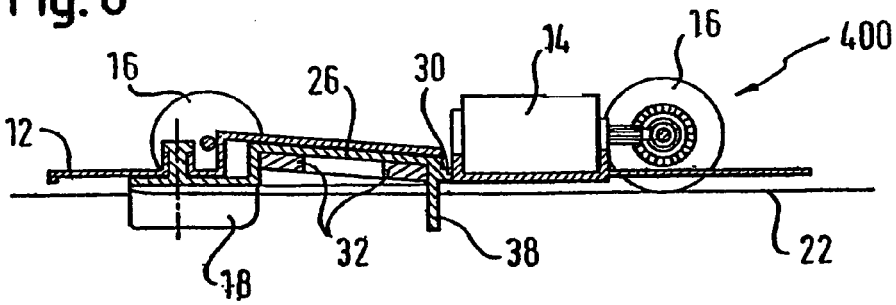
FIG. 6 is a longitudinal section through a fourth preferred embodiment of toy vehicle according to the invention.

FIG. 6 shows a fourth preferred embodiment of toy vehicle according to the invention 400, with parts which perform the same function being given the same reference numerals, for which reason the reader is referred to the above description of FIGS. 1 to 5 for explanations of such parts. In this fourth embodiment of toy vehicle 400, the swinging member 26 is mounted to be pivotable on the chassis 12 independently of the keel 18. To produce a pivoting movement of the swinging member 26 relative to the chassis 12, to allow the magnetic device 32 to be held above the conductor rails 24, the swinging member 26 has in the region of the magnetic device 32 a guide keel 38 which engages in the guide groove 20 (FIG. 3) in addition to the keel 18.

Figure 7:
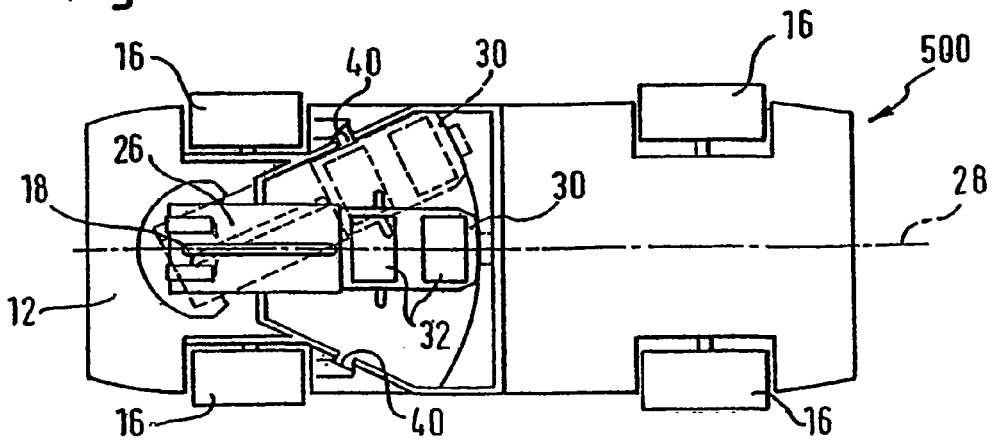
FIG. 7 is a top view of a fifth preferred embodiment of a toy vehicle according to the invention with the bodywork removed.

FIG. 7 shows a fifth preferred embodiment of toy vehicle according to the invention 500, with parts which perform the same function being given the same reference numerals, for which reason the reader is referred to the above description of FIGS. 1 to 6 for explanations of such parts. In this fifth embodiment of toy vehicle 500, a mechanical contact 40, belonging to a contact device which is not otherwise shown in detail, is arranged on the chassis 12 at each of the two end positions of the pivoting movement of the swinging member 26. In its end position, the swinging member 26 butts against the particular contact 40 and triggers it. The contact device then acts on a traction current fed to the motor 14 in such a way that the speed of travel is reduced or at least is not increased any further. This is intended to detect and defuse a borderline situation in which the toy vehicle is about to be flung off the circuit.

To allow the magnetic retaining force to be adjusted, the magnets 32 are arranged to be displaceable on the swinging member 26 in the longitudinal direction and in this way can be locked on the swinging member 26 in a position which is optimum for the particular driving style of a user.

Figure 8:
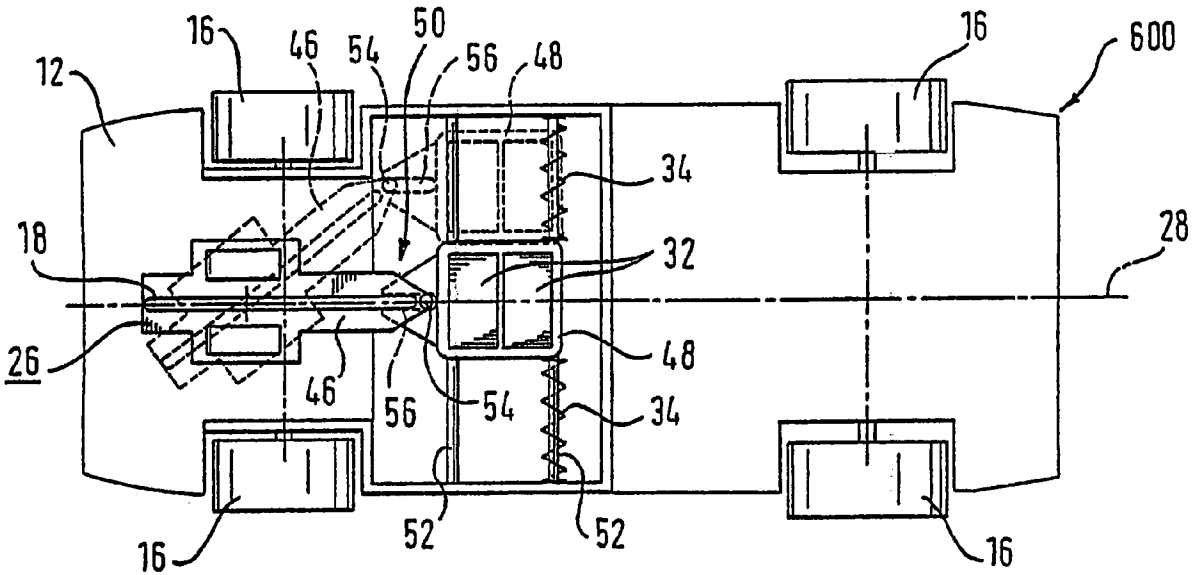
FIG. 8 is a top view of a preferred embodiment of a toy vehicle according to the invention with the bodywork removed.
Figure 9:
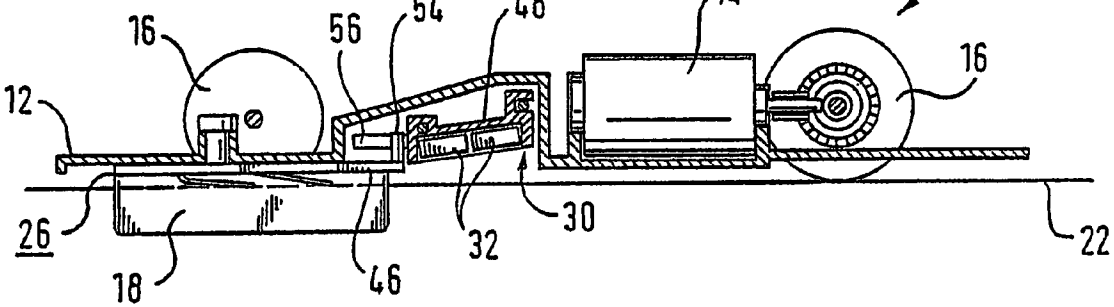
FIG. 9 is a longitudinal section through the toy vehicle of FIG. 8.
Figure 10:
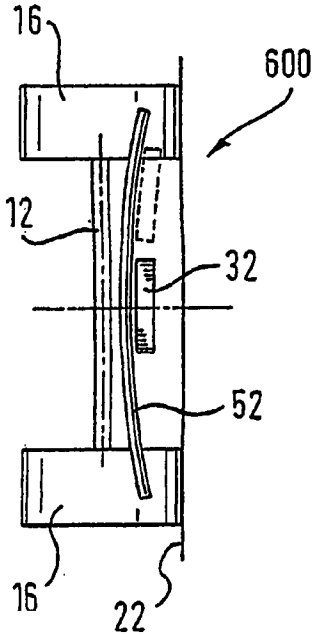
FIG. 10 is a view from the rear showing the toy vehicle of FIG. 8 with the bodywork removed.

FIGS. 8 to 10 show a further preferred embodiment of toy vehicle according to the invention 600, with parts which perform the same function being given the same reference numerals, for which reason the reader is referred to the above description of FIGS. 1 to 3 for explanations of such parts.

Between the free end 30 and the pivotable fixing of the swinging member 26, the latter is divided into a swinging part 46 and a magnet slide 48, which items are connected together by a pivot joint 50. An axis of pivot of the pivot joint 50 is orientated parallel to the axis of pivot of the keel 18. The magnet slide 48 is guided on two guide rails 52 perpendicularly to the direction of travel and thus performs a coercively guided lateral translatory movement relative to the toy vehicle 600. To convert the pivoting movement of the swinging part 46 into the lateral translatory movement of the magnet side 48, the pivot joint 50 is equipped with a cam-and-follower connection which allows combined translatory/pivoting movement of the magnet side 48 relative to the swinging member part 46. In this case a cam follower 54 is formed on the swinging part 46 and a cam 56 on the magnet slide 48, with the cam follower 54 engaging in the cam 56.

By virtue of the lateral translatory movement of the magnet slide 48 relative to the toy vehicle 600, it is possible, when the magnetic swinging member needs to take up only a small amount of room in the direction of travel, for the magnets 32 to move a very long distance outwards to the edge of the toy vehicle 600, thus enabling the magnets 32 to be held above the conductor rails even at large angles of drift.

As can be seen from FIG. 10, the guide rails are arranged to be curved down towards the circuit 22 in an outward direction, i.e. away from the centre position of the magnet slide 48, which means that, by a lateral translatory when the swinging member part 46 pivots, the magnet slide 48 performs, in addition, a translatory movement towards the circuit 22. In this way, there is obtained as a result of the shorter distance a magnetic force of attraction between the magnets 32 and the conductor rails on the circuit 22 which is all the higher the greater the angle of drift, i.e. the further the swinging part 46 pivots and displaces the magnet slide 48 on the guide rails 52 in the direction of the edge of the toy vehicle 600.

Provided on the guide rail 52 which is to the rear in the direction of travel, on each of the two sides of the magnet slide 48 is a return spring which is supported at one end against the magnet slide 48 and at an opposing end against an abutment on the chassis 12 of the toy vehicle 600, which means that, if there is any deflection of the magnet slide 48 from a centre position in which the swinging part 46 is aligned substantially parallel to the longitudinal axis 28 of the toy vehicle 600, a returning force acts on the magnet slide 48. This spring-generated returning force produces damping of the pivoting movement of the swinging part 46 and of the translatory movement of the magnet slide 48 and thus also damps any breakout of the toy vehicle 600 from its direction of travel when drifting in a bend. This also produces a braking action on the toy vehicle 600, which is all the greater the greater the angle of drift. This advantageously counteracts any flinging of the toy vehicle 600 off the circuit when travelling through bends.

The Invention claimed is:

1. A toy vehicle for a motor-racing circuit with guidance by tracks, said circuit having a guiding groove and conductor rails adjacent to said groove, the vehicle including a keel for guidance by the tracks, the keel being pivotably mounted on the vehicle for engagement with the guiding groove; a magnetic device for magnetic attraction interacting with the conductor rails for providing an additional retaining force for holding the vehicle on the track; a swinging member having one end pivotably mounted on the vehicle, the magnetic device being positioned on the swinging member at a distance from the pivotable mounting, the pivotably mounting being arranged so that in response to drift by the vehicle in the form of pivoting of a longitudinal axis of the vehicle relative to the motor-racing circuit, about the keel of the toy vehicle as a center of rotation, the swinging member pivots relative to the toy vehicle in the opposite direction of the drifting such that the magnetic device remains adjacent to the conductor rails on the motor-racing circuit, and there is a magnetic force of attraction between the magnetic device and the conductor rails.

2. A toy vehicle according to claim 1, wherein the magnetic device is positioned at a free end of the swinging member opposite from the pivotable mounting.

3. A toy vehicle according to claim 1, wherein the magnetic device has at least one permanent magnet.

4. A toy vehicle according to claim 1, wherein the swinging member is pivotable about a point between the pivotable mounting and the free end.

5. A toy vehicle according to claim 4, wherein the part of the swinging member which is on the side of the pivot point remote from the pivotable mounting of the swinging member to the toy vehicle carries the magnetic device and is arranged to be guided on at least one of the guide rails.

6. A toy vehicle according to claim 5, wherein the at least one guide rail is straight, and the pivot joint between the parts of the swinging member includes a cam-and-follower connection arranged such that in response to the swinging member pivoting relative to the toy vehicle, the two parts of the swinging member also perform a translatory/pivoting member.

7. A toy vehicle according to claim 5, wherein the at least one guide rail is formed such that in response to the swinging member pivoting relative to the toy vehicle from a center position where the swinging member is aligned substantially parallel to a longitudinal axis of the toy vehicle, the magnetic device undergoes translatory movement in the direction of the motor-racing circuit.

8. A toy vehicle according to claim 5, further including a spring device for exerting returning force on the part carrying the magnetic device towards a center position of the swinging member where the swinging member is aligned substantially parallel to a longitudinal axis of the toy vehicle.

9. A toy vehicle according to claim 1, further including a returning force on the swinging member towards a center position of the swinging member where the swinging member is aligned substantially parallel to a longitudinal axis of the toy vehicle.

10. A toy vehicle according to claim 1, wherein the pivotable mounting includes a guide rod for guiding the swinging member in the direction of pivoting movement of the guide rod.

11. A toy vehicle according to claim 1, wherein the at least one guide rail is formed such that in response to the swinging member pivoting relative to the toy vehicle from a center position where the swinging member is aligned substantially parallel to a longitudinal axis of the toy vehicle, the magnetic device undergoes translatory movement in the direction of the motor-racing circuit.

12. A toy vehicle according to claim 1, wherein the guide rod is arranged to slope down towards the motor-racing circuit from the center position of the swinging member while the vehicle is on the track.

13. A toy vehicle according to claim 1, further including a contact device arranged to be responsive to the swinging member reaching a predetermined angle of pivot relative to the toy vehicle for modifying a traction current supplied to a drive motor of the toy vehicle.

14. A toy vehicle according to claim 13, wherein the contact device has mechanical contacts on both sides relative to the swinging member, the mechanical contacts being arranged to physically abut respective end positions of the swinging member and trigger a contact for activating the contact device.

15. A toy vehicle according to claim 1, wherein the mechanical contacts are on the swinging member or on the vehicle.

16. A toy vehicle according to claim 13, wherein the contact device reduces or limits the traction current.

17. A toy vehicle according to claim 1, wherein the swinging member is connected to the keel of the toy vehicle so that the keel and swinging member turn together.

18. A toy vehicle according to claim 1, wherein the swinging member is mounted to be pivotable independently of the keel and has in the region of the magnetic device a guide keel for engaging the guiding groove of the motor-racing circuit.

* * * * *